United States Patent [19]

Shimojo et al.

[11] Patent Number: 4,506,650

[45] Date of Patent: Mar. 26, 1985

[54] IGNITION DEVICE FOR INTERNAL COMBUSTION ENGINES

[75] Inventors: Hirokazu Shimojo, Akatsukashin; Toshio Inamura, Tokyo, both of Japan

[73] Assignee: Kabushiki Kaisha Sigma Electronics Planning, Tokyo, Japan

[21] Appl. No.: 500,253

[22] Filed: Jun. 2, 1983

[30] Foreign Application Priority Data

Jun. 5, 1982 [JP] Japan ..... 57-95615

[51] Int. Cl.[3] ..... F02P 3/06; F02P 1/00; F02P 3/00

[52] U.S. Cl. ..... 123/620; 123/655

[58] Field of Search ..... 123/620, 655, 656, 650, 123/618

[56] References Cited

U.S. PATENT DOCUMENTS

| | | | |
|---|---|---|---|
| 3,565,048 | 2/1971 | Monpetit | 123/620 |
| 3,893,438 | 7/1975 | Diener | 123/620 |
| 4,083,347 | 4/1978 | Gräther et al. | 123/620 |
| 4,183,340 | 1/1980 | Gilbert | 123/620 |
| 4,345,575 | 8/1982 | Jorgensen | 123/620 |

*Primary Examiner*—Raymond A. Nelli

*Attorney, Agent, or Firm*—Robert E. Burns; Emmanuel J. Lobato; Bruce L. Adams

[57] ABSTRACT

An ignition device for an internal combustion engine, in which a current-supply terminal other than two end terminals of the second winding of the ignition coil is provided in the second winding or at the tertiary winding of the ignition coil: a diode is connected to the current-supplying terminal; a resistor is connected to one end of the secondary winding; the diode and the resistor are connected at one end in common; the spark gap of the combustion engine is connected between the common connection junction and the other end of the secondary winding; and the polarity of the diode is determined to be forward with respect to a discharge current flowing through the spark gap. An auxiliary power source may be provided in a network including the spark gap and the diode for increasing a discharge current of the spark gap.

9 Claims, 16 Drawing Figures

IGNITION DEVICE FOR INTERNAL COMBUSTION ENGINES

BACKGROUND OF THE INVENTION

The present invention relates to an ignition device for internal combustion engines.

In the ignition device of the type, a voltage high enough to break-down the spark gap of the internal combustion engine is necessary at the start of a discharge operation. On the other hand, a large discharge current should be supplied to the spark gap to heighten the firing effect of the engine. The above generation of the high voltage and the supply of the large discharge current are contradictory to each other for the formation of an ignition coil.

SUMMARY OF THE INVENTION

It is an object of the present invention to provide an ignition device for internal combustion engines which eliminates the abovesaid limitations imposed on the conventional design of the ignition coil and hence makes a high voltage for breaking down the spark gap and a large discharge current for ensuring firing to be compatible with each other.

To achieve the abovesaid object, in accordance with the present invention, a current-supplying terminal other than two end terminals of the second winding of the ignition coil is provided in the secondary winding or at the tertiary winding of the ignition coil; a diode is connected to the current-supplying terminal; an impedance element, such as a resistor, capable of flowing a direct-current is connected to one end of the secondary winding; the diode and the resistor are connected at one end in common; the spark gap is connected between the common connection junction and the other end of the secondary winding; and the polarity of the diode is determined to be forward with respect to a discharge current flowing through the spark gap.

BRIEF DESCRIPTION OF THE DRAWINGS

The present invention will be described in detail below in comparison with conventional art with reference to the accompanying drawings, in which.

DETAILED DESCRIPTION

To make characteristic features of the present invention clear, examples of conventional art will first be described.

Figure 1:
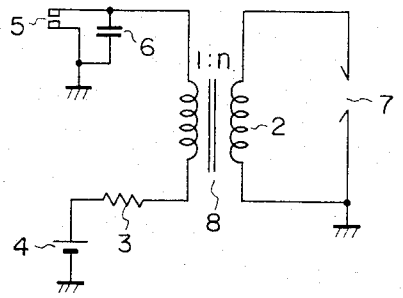
FIG. 1 is a circuit diagram illustrating an example of conventional ignition devices for internal combustion engines.

With reference to FIG. 1, an example of a conventional ignition device for internal combustion engines, reference numeral 1 indicates a primary winding of an ignition coil 8; 2 designates a secondary winding of the ignition coil; 3 identifies a resistor of primary side connected in series to the primary winding; 4 denotes a low-voltage source; 5 represents an interrupter; 6 shows a capacitor connected in parallel to the interrupter 5; and 7 refers to a spark gap connected across the secondary winding 2.

As shown in FIG. 1, the spark gap 7 is connected as a load of the secondary winding 2 in the conventional ignition device for internal combustion engines. The impedance of the spark gap 7 markedly varies in accordance with the presence or absence of a discharge across the spark gap.

That is to say, prior to the start of a discharge operation, the spark gap 7 produces a very high impedance and is regarded substantially as an insulator. Accordingly, the ignition device has to output a voltage high enough to rupture the insulation of the spark gap 7, ensuring its breakdown.

To this end, it is necessary for the ignition coil 8 that the voltage transformation ratio be large, that is, the turn ratio n of the secondary winding 2 to the primary winding 1 be large. This is defined as a voltage condition in this specification.

On the other hand, after the discharge is started, a discharge current flows across the spark gap 7 and its impedance becomes sufficiently lower than the output impedance of the ignition device. Moreover, in this state, in order to heighten the firing effect of the engine, it is necessary that a discharge current as large as possible be supplied to the spark gap 7.

To perform this, it is required that the current transformation ratio be large, that is, the turn ratio n of the secondary winding 2 to the primary winding 1 be small. This is defined as a current condition in this specification.

As will be appreciated from the above, the voltage condition and the current condition are contradictory to and incompatible with each other; therefore, a point of compromise has been sought for between the two conditions in the design of the ignition coil 8.

With reference to the accompanying drawings, the present invention will hereinafter be described in detail.

Figure 2:
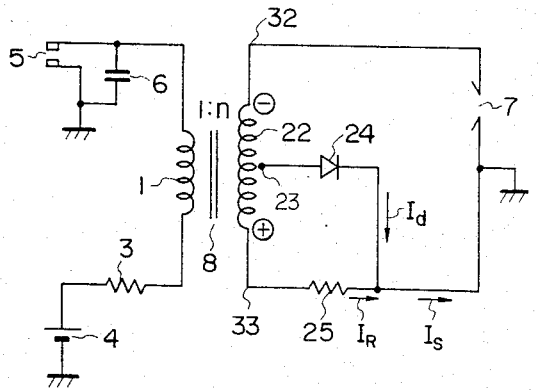
FIG. 2 is a circuit diagram illustrating an embodiment of the present invention as being applied to the device of FIG. 1.

FIG. 2 is a circuit diagram illustrating an embodiment of the present invention. In FIG. 2, the same reference numerals are used as those in connection with FIG. 1 for the same components.

In FIG. 2, reference numeral 22 indicates a secondary winding of the ignition coil 8; 23 designates an intermediate-tap provided in the secondary winding 22; 24 identifies a diode connected at one end to the intermediate-tap 23, the diode being connected in a forward direction with respect to a discharge current so that it may withstand against an output voltage induced in the secondary winding 22; 25 denotes a resistor connected between one end of the secondary winding 22 and the spark gap 7; 32 represents an output end of the secondary winding 22; and 33 shows a return circuit end of the secondary winding 22.

Reference character $I_d$ indicates a current flowing through the diode 24; $I_R$ designates a current flowing through the resistor 25; and $I_s$ identifies a discharge current flowing through the spark gap 7.

In this embodiment, the polarity of the diode 24 and the directions of the currents are determined on the assumption that a negative voltage is applied to the spark gap 7.

During operation, when a current flowing through the primary winding 1 is cut off by a known operating mechanism, a high voltage is induced across the secondary winding 22, that is, between its output end 32 and return circuit end 33, and the high voltage is applied via the resistor 25 to the spark gap 7.

Before starting the discharge, the impedance of the spark gap 7 is so high that if the value of the resistor 25 is selected sufficiently small as compared with the gap impedance, then the influence of the resistor 25 can be neglected. Since the polarity of the diode 24 connected to the intermediate-tap 23 of the secondary winding 22 is determined with respect to the polarity of the output voltage so that the diode may withstand against the output voltage, there is no influence of the diode.

Thus, when the high voltage applied to the spark gap 7 exceeds a certain value, the spark gap breaks down, producing a capacitive discharge first. Then, the discharge changes to an inductive discharge, allowing a discharge current through the spark gap 7 for a relatively long time.

The capacitive discharge is produced by a local release of energy stored in a capacitance around the spark gap 7 during a very short duration and exerts substantially no influence on the firing effect; accordingly, the word "discharge" will mean the "inductive discharge" in the following description.

As will be evident from FIG. 2, the current path from the secondary winding 22 to the spark gap 7 has two branches such as follows:

(i) Diode branch including the diode 24

[Intermediate-tap 23 of the secondary winding 22→diode 24→spark gap 7→output end 32 of the secondary winding]

(ii) Resistor branch including the resistor 25

[Return circuit end 33 of the secondary winding→resistor 25→spark gap 7→output end 32 of the secondary winding]

Letting a discharge current flowing in the first diode branch, a discharge current flowing in the second resistor branch and a discharge current flowing across the spark gap 7 be represented by $I_d$, $I_R$ and $I_s$, respectively, the following relation apparently holds:

$$I_s = I_d + I_R$$

In this case, if the value of the resistor 25 is selected so that the current $I_R$ may be sufficiently smaller than the current $I_d$ and that the influence of the former may be neglected, it follows that $$I_s \simeq I_d$$

This means that the discharge current flowing through the spark gap 7 is effectively supplied from a winding between the intermediate-tap 23 and the output end 32 of the secondary winding 22, and the turn ratio of the secondary winding 22 to the primary winding 1 is effectively tapped down by the intermediate-tap 23. Accordingly, when the diode 24 becomes conductive, the current transformation ratio increases, obtaining a large discharge current.

From the foregoing description, it is self-evident that the circuit of FIG. 2 can satisfy the voltage condition and the current condition independently of each other.

FIG. 3 is an equivalent circuit representation of the foregoing description.

Figure 3A:
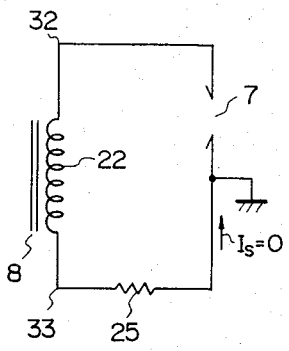
FIGS. 3A, 3B, 3C and 3D are equivalent circuit diagrams explanatory of its operation.

FIG. 3A shows a state prior to the start of a discharge, in which a voltage induced across the secondary winding 22 of the ignition coil 8 is applied via the resistor 25 to the spark gap 7. At this time, since substantially no current flows through the spark gap 7, $I_s=0$ and, consequently, $I_d=0$. That is to say, since the diode 24 remains in the OFF state, the diode branch is omitted from this equivalent circuit.

Figure 3B:
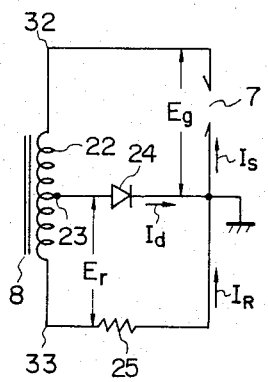

FIG. 3B shows a state after starting the discharge. At this time, the diode 24 becomes conductive and the current $I_d$ substantially equal to the discharge current $I_s$ flows through the diode, so that the tap 23 of the secondary winding 22 becomes equivalent to being grounded. If the position of the intermediate-tap 23 is selected to be k% of the entire turn number of the secondary winding 22 from the return circuit end 33 and if the voltage across the spark gap 7 is taken as a value $E_g$, then the voltage between the tap 23 and the output end 32 is a value $E_g$. As illustrated by way of example in FIG. 2, the intermediate tap is at approximately the middle of the secondary winding.

Therefore, a voltage $E_r$ between the return circuit end 33 and the intermediate-tap 23 is given by $$E_r = \frac{k}{100-k} E_g$$

Accordingly, if the impedance (resistance) value of the resistor 25 is taken as a value R and if the impedance of the winding 22 is neglected, the following current:

$$I_R = \frac{k}{100-k} \cdot \frac{E_g}{R}$$

flows through the resistor 25. During the discharge period, since the voltage $E_g$ remains substantially constant, the current $I_R$ also remains approximately constant.

Figure 3C:
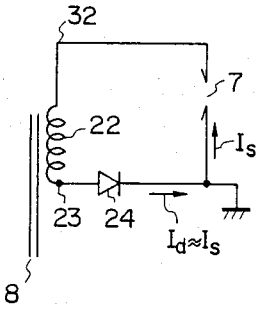

In this case, if the impedance R of the resistor 25 is selected so that $$I_R << I_d$$

since the current $I_R$ is negligible, the resistor branch is omitted from FIG. 3B and an equivalent circuit of FIG. 3C is obtained. In other words, the discharge current $I_s$ becomes approximately equal to the discharge current $I_d$. With the lapse of time the discharge current $I_s$ and consequently the diode current $I_d$ is also gradually reduced to zero.

Figure 3D:
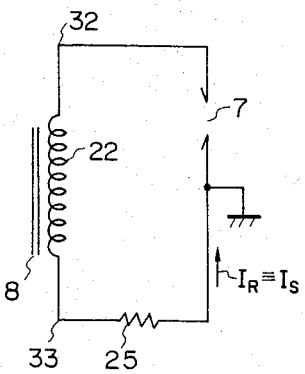

FIG. 3D shows a state after the diode current $I_d$ becomes zero. At this time, since the diode 24 is returned to the OFF state, the current $I_s(\equiv I_R)$ is supplied again from the entire secondary winding 22 to the series circuit of the resistor 25 and the spark gap 7.

Accordingly, in this case, (1) because of increased effective turn ratio, that is, reduced current transformation ratio and (2) because of decreased load effect by the spark gap 7, the waveform of the discharge current $I_s$ undergoes a change at the time when $I_d=0$.

Figure 4:
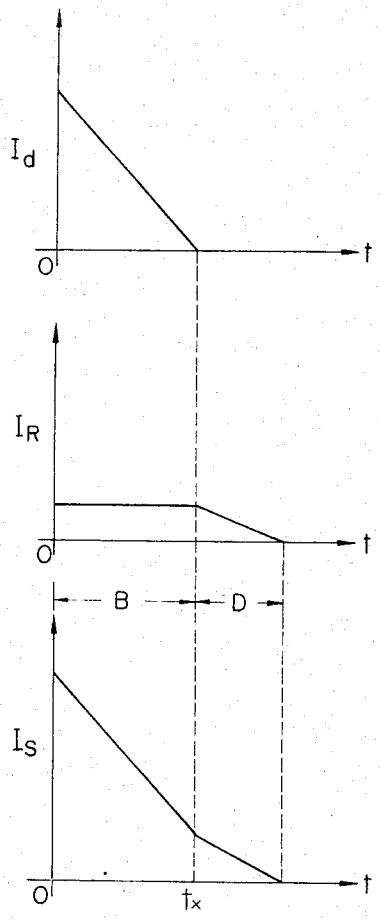
FIG. 4 is a waveform diagram showing variations in currents with time at respective parts in FIG. 2.

FIG. 4 is a graphical illustration of the state of the currents $I_s$, $I_d$ and $I_R$ in the periods shown in FIGS. 3B and 3D showing that the waveform of the current $I_s$ changes at the moment $t_x$ when the current $I_d$ becomes zero. The relation:

$$I_s=I_d+I_R$$

is always maintained throughout the entire periods shown in FIGS. 3B and 3D.

Figure 5A:
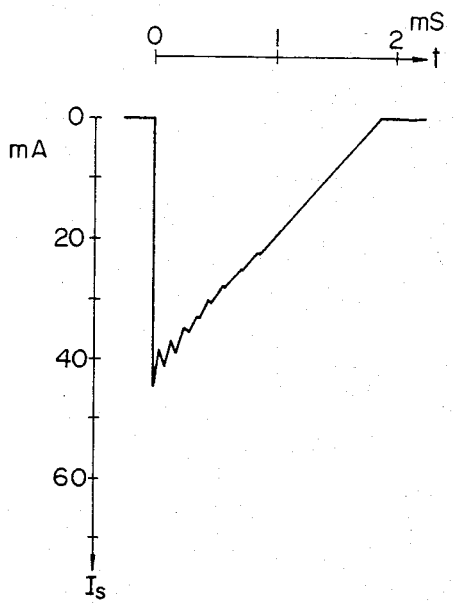
FIGS. 5A and 5B are waveform diagrams showing a measured example of a discharge current in the embodiment of FIG. 2 in comparison with that of a conventional example.
Figure 5B:
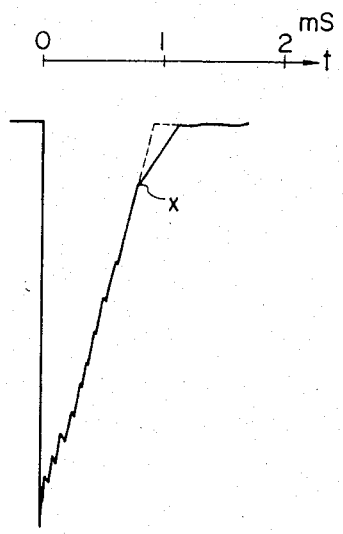

FIGS. 5A and 5B show measured waveforms of discharge currents obtained by experiments of the present inventor. FIG. 5A shows the waveform in the conventional ignition device of FIG. 1 and FIG. 5B the waveform in the embodiment of FIG. 2.

In case of the conventional device of FIG. 5A, a current of about 40 mA was obtained as an initial value of the discharge current, whereas, in case of the embodiment of the present invention of FIG. 5B, a current of about 60 mA was obtained as an initial value of the discharge current. The increase of the discharge current as much as approximately 50% from 40 mA up to 60 mA is obtained by the automatic tap-down operation of the turn ratio which is a function performed by the tap of the secondary winding and the diode branch.

In the device of the present invention of FIG. 5B, the waveform has a distinct point of inflection as indicated by an arrow X; this has been described previously in connection with the operation. In FIG. 5B, the waveform indicated by the broken line is an assumed waveform in a case of no inflection.

In case of FIG. 5B, the duration of discharge is about 0.9 mS from the broken-line waveform, while in case of FIG. 5A, the duration is approximately 1.8 mS. That is to say, in the embodiment of the present invention, the duration of discharge is one-half that in the conventional device.

This is quite natural in view of the facts that theoretically constant energy is stored in the primary winding 1 of the ignition coil 8 in each of the device of the present invention and the conventional device, and that in case of the present invention, the discharge current value increases by a value of approximately 50% in comparison with the conventional device, doubling the instantaneous energy.

As has been described in the foregoing, the present invention, when applied to the conventional coil discharging type ignition device, makes it possible to obtain both a sufficiently high voltage and a large discharge current. Such a feature of the present invention exhibits a maximum effect when the invention is applied to an ignition device of the type employing an auxiliary power source.

Figure 6:
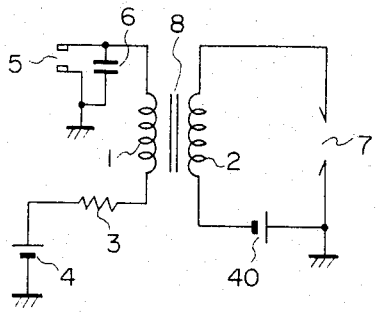
FIG. 6 is a circuit diagram illustrating an example of a conventional auxiliary power source type ignition device.

FIG. 6 shows a conventional ignition device using an auxiliary power source.

In this device, as will be seen from comparison with the device of FIG. 1, an auxiliary power source 40 for reinforcing a discharge of the spark gap 7 is connected in series (or in parallel) to the circuit including the spark gap 7 and the secondary winding 2 in an ordinary coil discharging type ignition device.

The operations of this device can be briefly described as follows:

(1) A high voltage induced by a known mechanism in the secondary winding 2 is superimposed on the voltage of the auxiliary power source 40 and applied to the spark gap 7, generating a discharge operation.

(2) This discharge, once started, serves as a trigger discharge to trigger the auxiliary power source 40, causing it to start a discharging operation. This discharge is superimposed on the trigger discharge.

(3) Even after completion of the release of primary energy stored in the primary winding 1, the discharge is sustained for a relatively long time by an energy supply from the auxiliary power source 40.

With such an ignition device employing an auxiliary power source, a current from the auxiliary power source 40 flows via the secondary winding 2. Accordingly, it is unavoidable that a sudden change in the current is hindered by the fly-wheel effect by the inductance of the secondary winding 2, and that an energy loss is caused by the impedance of the secondary winding 2.

Therefore, it is essentially difficult in the ordinary ignition device using an auxiliary power source to start reinforcement of the discharge current immediately after the start of the discharge; in consequence, the initial value of the entire discharge current is substantially equal to that of the trigger discharge. Consequently, an increase in the initial value of the discharge current of the trigger discharge leads to an increase in the entire discharge current; therefore, the present invention is very significant in this sense.

Figure 7:
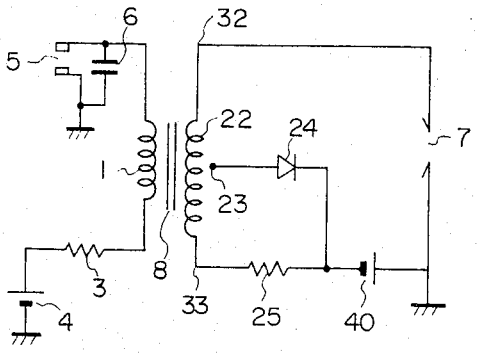
FIG. 7 is a circuit diagram illustrating another embodiment of the present invention as being applied to the device of FIG. 6.

FIG. 7 illustrates a circuit diagram of an auxiliary power source type ignition device embodying the present invention. In FIG. 7, the same reference numerals are used as those in connection with FIGS. 2 and 6 for the same components. This embodiment corresponds to a device in which the auxiliary power source 40 is connected to the network including the spark gap and the diode in FIG. 2.

The operation of this embodiment is substantially the same as those in FIGS. 2 and 6; hence no description will be repeated. However, marked effects are produced by;

(1) an increase in the initial value of the discharge current, as referred to previously;

(2) a decrease in the inductance of the secondary winding 22 in response to the start of discharge, which facilitates reinforcement of the discharge current; and (3) a decrease in the impedance of the secondary winding 22, which alleviates a power loss to heighten the effect mentioned above in the item (2).

Figure 8A:
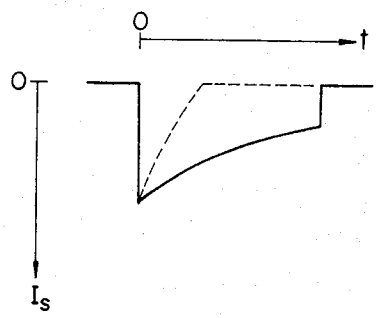
FIGS. 8A and 8B are schematic waveform diagrams showing a discharge current in the embodiment of FIG. 7 in comparison with that of a conventional example.
Figure 8B:
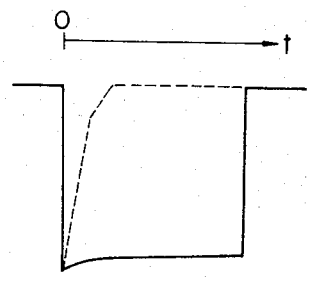

FIGS. 8A and 8B schematically show the waveforms of the discharge current obtained by the auxiliary power source type ignition device. FIG. 8A shows the waveform of the discharge current in case of the ordinary auxiliary power source type ignition device depicted in FIG. 6, and FIG. 8B shows the waveform of the discharge current in case of the embodiment of the present invention shown in FIG. 7. Incidentally, in each case, the waveform of the trigger discharge (the discharge in the absence of the auxiliary power source) is indicated by the broken line.

As will be evident from comparison of the above waveforms (A) with (B) in FIG. 8, the present invention, even when applied to the auxiliary power source type ignition device, simultaneously achieves the generation of a high voltage for starting a discharge operation and a marked discharge current reinforcing effect.

Figure 9:
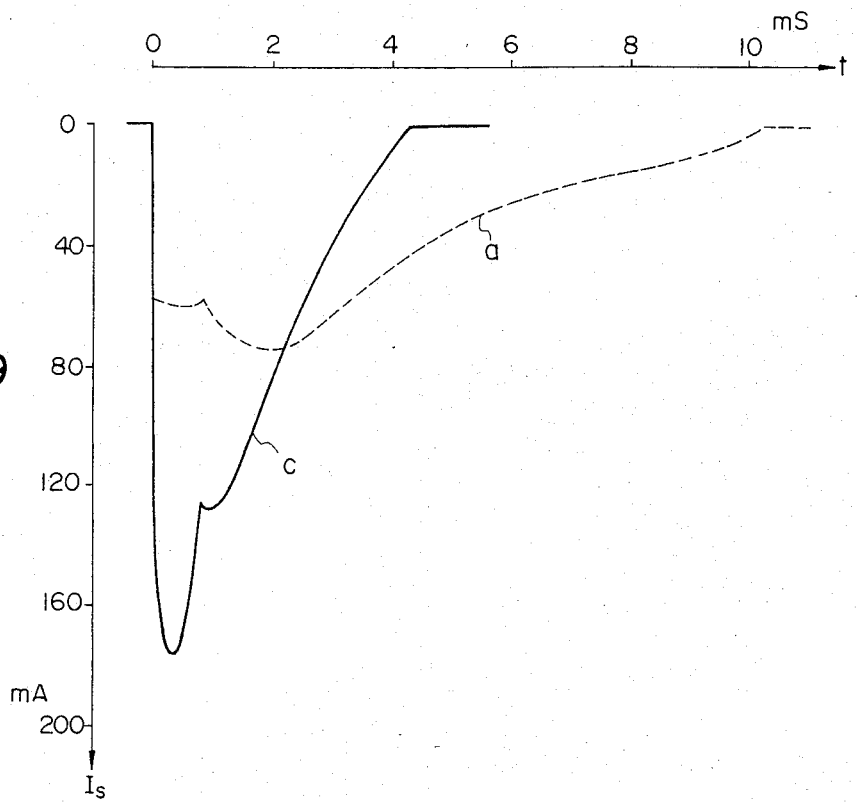
FIGS. 9 and 10 are waveform diagrams showning examples of discharge currents in the embodiment of FIG. 7 in comparison with a conventional example.
Figure 10:
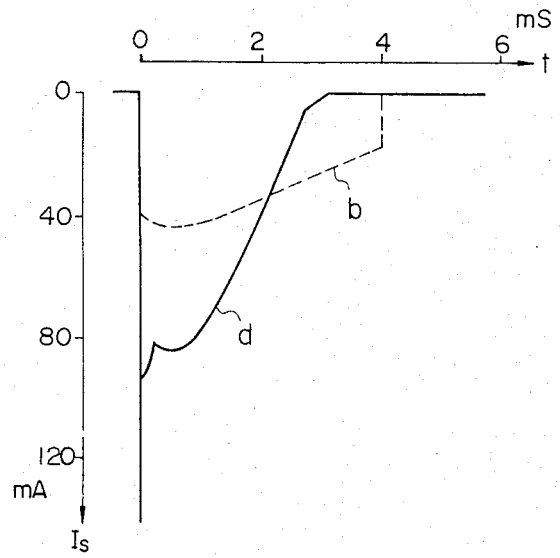

Referring next to FIGS. 9 and 10, the results of experiments conducted by the present inventor on the embodiment of FIG. 7 will be described more concretely.

By the way, as the auxiliary power source 40 of this case was used a DC-DC converter with a feedback circuit disclosed in Japanese Pat. No. 1080198 owned by the present inventor.

FIGS. 9 and 10 show measured results of a discharge current which flowed through the spark gap 7 when the interrupter contact 5 in FIGS. 6 and 7 was opened and closed at intervals corresponding to revolving speeds 600 rpm and 3,000 rpm of a four-cylinder engine.

Of these waveforms, the broken-line waveforms a and b are discharge current waveforms in case of the conventional example shown in FIG. 6, and the solid-line waveforms c and d are discharge current waveforms in case of the embodiment of the present invention illustrated in FIG. 7.

As will be seen from comparison of the waveforms shown in FIGS. 9 and 10 with each other, the present invention is characterized by following features:

(1) the initial value of the discharge current increases;

(2) the duration of discharge is appropriately controlled to be reduced over the entire revolving speeds of an internal combustion engine from a low-speed running to a high speed running;

(3) that is to say, the release of energy to the spark gap mostly takes place immediately after the start of a discharge.

Such features as mentioned above are highly desirable to the ignition device for internal combustion engines.

Figure 11:
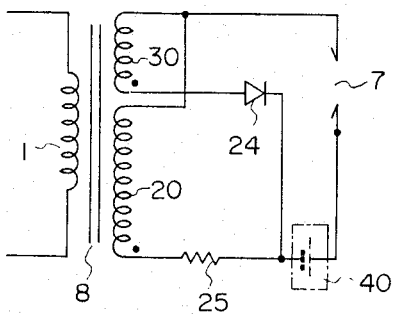
FIG. 11 is a circuit diagram illustrating a third embodiment of the present invention.

While the foregoing description has been given of the case where the intermediate-tap is provided in the secondary winding, the intermediate-tap can be replaced by a tertiary winding as is well known. FIG. 11 is a circuit diagram illustrating the principal part of a third embodiment of the present invention which is provided with a tertiary winding.

In FIG. 11, the same reference numerals as those in FIG. 7 indicate the identical or the same components. Reference numeral 20 indicates a secondary winding of the ignition coil 8 and 30 a tertiary winding of the coil 8. The secondary winding 20 and the tertiary winding 30 are connected together at one end in common and connected to one end (the non-grounded side in this example) of the spark gap 7.

To the other ends of the secondary winding 20 and the tertiary winding 30 are connected to a resistor 25 and a diode 24, respectively. The other sides of the resistor 25 and the diode 24 are connected in common and connected (via the auxiliary power source 40 in a case of the auxiliary power source type) to the other terminal of the spark gap 7.

In this case, the polarity of the diode 24 is forward with respect to the discharge current of the spark gap 7 as is evident from FIG. 11. The number of turns of the secondary winding 20 is larger than that of the tertiary winding 30.

During operation, the spark gap 7 is broken down by a voltage induced across the secondary winding 20, starting a discharge operation. The discharge current is branched to the diode 24 and the resistor 25. However, by selecting the value of the resistor 25 to be sufficiently large, the discharge current can be mostly applied to the diode 24. Thereafter, the discharge current is supplied via the diode 24 from the tertiary winding 30.

In this way, the same operational effects as those described previously with regard to the first and second embodiments are also produced in the third embodiment.

Although the present invention has been described in respect of a case where a resistor is connected in series to the secondary winding, the invention can equally be applied even if the resistor is substituted by an impedance, such as a coil.

As will be appreciated from the foregoing description, according to the present invention, (1) the generation of a high voltage for ensuring breakdown of the spark. gap and (2) reinforcement of the discharge current for improving the firing performance, which have been regarded as impossible to achieve at the same time, can be made compatible with each other. Especially, they present invention, when applied to the auxiliary power source type ignition device, permits a substantially ideal firing operation of an internal combustion engine.

What we claim is:

1. An ignition device for an internal combustion engine, comprising: an ignition coil having a primary winding and a secondary winding, an impedance element having one end connected to one end of the secondary winding and the other end connected to one of the terminals of a spark gap, a diode having one terminal connected to an intermediate-tap of the secondary winding and having the other terminal connected to the other end of the impedance elememt, and means for interconnecting the other terminal of the spark gap and the other end of the secondary winding, the diode being arranged in a forward direction with respect to a discharge current of the spark gap.

2. An ignition device for an internal combustion engine, comprising: an ignition coil having a primary winding and a secondary winding, an impedance element having one end connected to one end of the secondary winding and the other end connected to one of the terminals of a spark gap, a diode having one terminal connected to an intermediate-tap of the secondary winding and having the other terminal connected to the other end of the impedance element, means for interconnecting the other terminal of the spark gap and the other end of the secondary winding, and an auxiliary power source connected to a network including the spark gap and the diode for increasing a discharge current of the spark gap, the diode being arranged in a forward direction with respect to a discharge current of the spark gap.

3. An ignition device for an internal combustion engine, comprising: an ignition coil having a primary winding, a secondary winding and a tertiary winding, a spark gap having one terminal connected to one end of each of the secondary winding and a tertiary winding, an impedance element having one end connected to the other end of the secondary winding and the other end connected to the other terminal of the spark gap, and a diode having one terminal connected to the other end of the tertiary winding and having the other terminal connected to the other end of the impedance element, the number of turns of the secondary winding being larger than the number of turns of the tertiary winding, and the diode being arranged in a forward direction with respect to a discharge current of the spark gap.

4. An ignition device for an internal combustion engine, comprising: an ignition coil having a primary winding, a secondary winding and a tertiary winding, a spark gap having one terminal connected to one end of each of the secondary winding and a tertiary winding, an impedance element having one end connected to the other end of the secondary winding and the other end connected to the other terminal of the spark gap, a diode having one terminal connected to the other end of the tertiary winding and having the other terminal connected to the other end of the impedance element, and an auxiliary power source connected to a network including the spark gap and the diode for increasing a discharge current of the spark gap, the number of turns of the secondary winding being larger than the number of turns of the tertiary winding, and the diode being arranged in a forward direction with respect to a discharge current of the spark gap.

5. An ignition device according to claim 1, in which said impedance element is a resistor.

6. An ignition device according to claim 2, in which said impedance element is a resistor.

7. An ignition device according to claim 3, in which said impedance element is a resistor.

8. An ignition device according to claim 4, in which said impedance element is a resistor.

9. An ignition device according to claim 1, in which said intermediate-tap is at approximately the middle of said secondary winding.

* * * * *